US010183208B2

(12) United States Patent
Juillan

(10) Patent No.: US 10,183,208 B2
(45) Date of Patent: Jan. 22, 2019

(54) DEVICE FOR TOWING A BOARD FOR BOARD SPORTS

(71) Applicant: Michel Juillan, Villers les Nancy (FR)

(72) Inventor: Michel Juillan, Villers les Nancy (FR)

( * ) Notice: Subject to any disclaimer, the term of this patent is extended or adjusted under 35 U.S.C. 154(b) by 205 days.

(21) Appl. No.: 14/904,668

(22) PCT Filed: Jul. 15, 2014

(86) PCT No.: PCT/FR2014/051820
§ 371 (c)(1),
(2) Date: Jan. 12, 2016

(87) PCT Pub. No.: WO2015/004406
PCT Pub. Date: Jan. 15, 2015

(65) Prior Publication Data

US 2016/0166913 A1 Jun. 16, 2016

(30) Foreign Application Priority Data

Jul. 12, 2013 (FR) ..... 13 56874

(51) Int. Cl.
*A63B 71/00* (2006.01)
*A63C 11/02* (2006.01)

(52) U.S. Cl.
CPC ..... *A63B 71/0036* (2013.01); *A63C 11/026* (2013.01)

(58) Field of Classification Search
CPC . A63C 11/026; A63C 11/023; A63B 71/0036; A63B 1/262; A63B 1/125; B62B 1/125
See application file for complete search history.

(56) References Cited

U.S. PATENT DOCUMENTS 4,684,141 A * 8/1987 Nunokawa ..... B62B 1/125 280/40
5,106,112 A * 4/1992 Sargent ..... A63C 11/026 224/917

(Continued)

FOREIGN PATENT DOCUMENTS

DE 26 50 077 A1 5/1978
DE 10 2006 026993 A1 12/2007

(Continued)

*Primary Examiner* — Hau V Phan
(74) *Attorney, Agent, or Firm* — Craft Chu PLLC; Andrew W. Chu

(57) ABSTRACT

The telescopic device for towing a board for board sports includes a base mounted on the board; and a skid with an in-use position positioned spaced apart from the base, and an out-of-use position positioned close to the base. There is a mechanism for mounting the skid so as to slide relative to the base between the in-use position and the out-of-use position and mechanism for retaining the skid in the in-use position, that includes part of the skid and an additional retaining device that is part of the mechanism for mounting the skid. The mechanism for retaining has an active position for holding the skid in the in-use position. The active position is intended for a movement stress, which is exerted on the skid in the direction of the out-of-use position. There is an inactive retaining position intended for a stress that is greater than a predetermined stress.

12 Claims, 4 Drawing Sheets

(56) References Cited

U.S. PATENT DOCUMENTS

| | | | | |
|---|---|---|---|---|
| 5,340,153 | A * | 8/1994 | Parker | A63C 11/026 280/47.17 |
| 6,086,102 | A * | 7/2000 | Stark | A63C 11/026 224/917 |
| 6,447,002 | B1 * | 9/2002 | Fang | A45C 13/385 280/47.29 |
| 6,848,718 | B2 * | 2/2005 | Ravikumar | A63C 11/023 280/35 |
| 6,923,466 | B2 * | 8/2005 | Tsai | B62B 1/125 280/38 |
| 7,490,858 | B1 * | 2/2009 | Sellers | A63C 11/026 280/47.26 |
| 7,798,528 | B2 * | 9/2010 | Sellers | A63C 11/026 280/47.26 |
| 8,141,905 | B2 * | 3/2012 | Ball | A63C 11/026 280/47.131 |
| 8,360,474 | B2 * | 1/2013 | Lurie | A63C 11/026 280/47.26 |
| 9,586,128 | B2 * | 3/2017 | Condoianis | A63C 11/026 |

FOREIGN PATENT DOCUMENTS

| | | |
|---|---|---|
| NL | 1 015 688 C2 | 1/2002 |
| NL | 1 026 982 C2 | 3/2006 |

* cited by examiner

DEVICE FOR TOWING A BOARD FOR BOARD SPORTS

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The invention is related to the field of the accessories for boards for board sports. It relates more particularly to a device for towing a board for board sports, such as a ski, made integral with the rear end of the board or ski, which portion is referred to as the heel, which permits the skier to tow the skis, with the spatulas in the palm of the hand, the latter being held together, soles against soles in a position inclined by about 30 degrees with respect to the horizontal and resting on the ground through the rolling element.

2. Description of Related Art Including Information Disclosed Under 37 CFR 1.97 and 37 CFR 1.98.

In a winter sports resort the transport of the skis usually carried out by the skier at arms' length or on the shoulders can prove difficult or very difficult, depending on distances to walk. The parking areas in the ski resorts are becoming increasingly larger and the distances to walk to reach the start of the ski lifts are also becoming increasingly larger and mostly uphill.

From the patent FR 7931057 is known a support for skis facilitating their displacement by rolling. This device is comprised of a wheel mounted on the support and two flanges receiving the ends of the two skis.

From patent CH 672434 is also known a device for towing skis comprised of a wheel mounted on a U-shaped part placed at the end of a ski, then locked by a screw clamp.

The patent application DE 2650077 relates to another device for towing with a wheel fixed to one of the skis comprising a closing case.

The patent application DE 102006026993 relates to yet another device for towing with a wheel fixed to one of the skis comprising a base for fastening to one of the skis. The wheel must be fixed to the base by the user in order to permit him to activate the device.

In the patents cited, the devices are poorly adapted for mounting on skis having curved heels. They have the drawback of being bulky and of having to be transported, for some of them, permanently by the skier in a backpack, and of having to be removed from this bag at the time of their use. They also have the drawback of a more or less long, tedious, even difficult installation in the case of freezing temperatures or snowfall. They must be removed after their use and placed in a tight cover, then in the backpack.

BRIEF SUMMARY OF THE INVENTION

The present invention pretends to cope with at least some of the aforementioned drawbacks and provides a solution that permits the skier an easy "putting into use", made with a single gesture, as well as its "putting out of use".

To this end, the invention relates to a device for towing a board for board sports, namely a ski, including:

a base designed to be mounted on the board for board sports;

a skid likely to adopt, on the one hand, an in-use position, in which this skid is positioned spaced apart from said base and, on the other hand, an out-of-use position, in which said skid is positioned close to said base;

means for slidably mounting the skid with respect to said base, between the in-use position and the out-of-use position;

means for retaining the skid in the in-use position comprising, on the one hand, a retaining organ the skid includes and, on the other hand, a complementary retaining organ the means for slidably mounting include;

wherein said retaining means are designed to adopt, on the one hand, an active position for retaining the skid in the in-use position, for a displacement stress exerted onto the skid and in the direction of its out-of-use position, lower than a determined stress and, on the other hand, an inactive position for retaining, for a stress that is greater than this determined stress.

More particularly, said device comprises means for holding said skid in the out-of-use position, said holding means including, on the one hand, a holding organ said skid includes and, on the other hand, a complementary holding organ said means for slidably mounting include, said holding means being designed to adopt, on the one hand, an active position for holding the skid in the out-of-use position, for a displacement stress exerted onto said skid and in the direction of its in-use position, lower than a determined stress and, on the other hand, an out-of-use position for holding, for a stress that is greater than this determined stress.

According to a preferred embodiment, either said retaining organ and/or said holding organ or said complementary retaining organ and/or said complementary holding organ are of a retractable type and are designed to be retracted under the action of said displacement stress, on the one hand, exerted onto said skid and in the direction of said position, as the case may be out-of-use or in-use position, and, on the other hand, that is greater than said determined stress.

Advantageously, said retaining organ and/or the holding organ, respectively said complementary retaining organ and/or said complementary holding organ are comprised of at least one retractable tongue provided with at least one lug, while said complementary retaining organ and/or said complementary holding organ, respectively the retaining organ and/or the holding organ are comprised of at least one notch designed to cooperate with said lug of said tongue.

Preferably, said retaining organ and said holding organ are comprised of at least one retractable tongue said skid includes.

According to another preferred embodiment, said skid has a free end including sliding means or rolling means.

Advantageously, said skid has, on the one hand, a first end including sliding means or rolling means and, on the other hand, a second end opposite the first end and including said retaining organ.

Preferably, said means for slidably mounting the skid relative to the base include, on the one hand, a guiding part as well as means for mounting this guiding part on said base and, on the other hand, a system for slidably mounting the skid on the guiding part.

According to other features:

said system for slidably mounting includes, on the one hand, at least one groove, respectively at least one rib, said base or said guiding part mounted on such base includes and, on the other hand, at least one rib, respectively at least one groove, said skid includes and which cooperates with said groove, respectively with said rib, of said base or said guiding part;

said device includes at least one means for preventing said skid from fully separating from said base, in the out-of-use position and/or in the in-use position of said skid;

said means preventing said skid from separating from said base includes, on the one hand, a stop provided on the skid and, on the other hand, a bearing surface, which said stop cooperates with and the means for slidably mounting includes.

The invention also relates to an assembly including a board for board sports and a device for towing this board for board sports.

According to other features, this assembly includes fastening means for fastening the device for towing, in particular the base of this device, to the board for board sports, whereby this fastening may be close to the heel of the board for board sports.

The advantage resulting from the present invention consists in that it provides a small-size device for towing a board for board sports, such as a ski, made integral with the upper portion of the end of the ski, which portion is referred to as heel, having the advantage of neither having to be transported by the skier on the slopes, nor to be mounted and dismounted before and after its use, to be permanently available and, in preferred embodiments, the "putting into use" of which occurs by a single gesture of the hand by extracting the rolling element. The putting "out of use" occurring by simply pressing the heels of the skis on the ground. It has the advantage of being functional on all skis currently present on the market, irrespective of the transverse and longitudinal curve of their heels. It also has the advantage of having, in a particular embodiment of the invention, a protective cover, which can be locked and which covers the mechanism and the rolling element, protecting the latter from all insertions of various elements such as: roots, branches, when practicing skiing, which can cause the skier to fall.

Other features and advantages of the invention will become clear from the following detailed description, which refers to an embodiment given as an indication and without restriction.

The understanding of this description will be facilitated when referring to the attached drawings.

DETAILED DESCRIPTION OF THE INVENTION

The present invention is related to the field of manufacture of accessories for equipping a board for board sports.

This invention will find a particularly suitable, but in no way restrictive, application for a board for board sports for sliding on the snow. Such a board may then be formed by a ski, a monoski or a surfboard or the like.

The invention then relates to a device for towing 1 a board for board sports 100. Such a device 1 is designed to be adapted to any board for board sports 100, namely a board for board sports 100 as mentioned above.

In FIGS. 1 to 13 is shown a first kind of embodiment of such a device for towing 1 according to the invention and comprising a rolling means.

Figure 1:
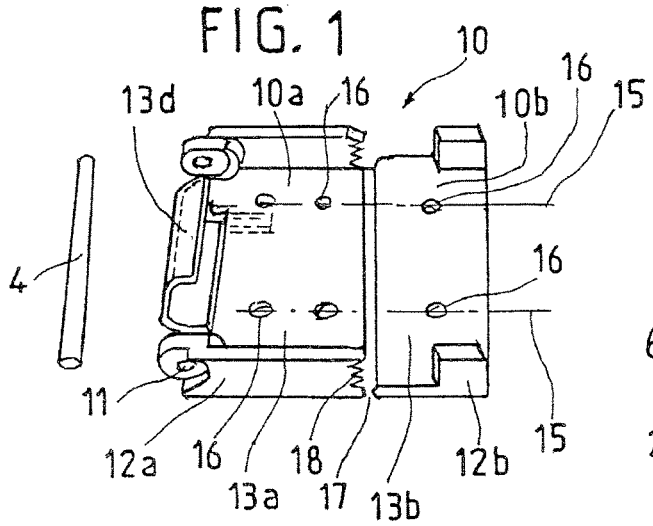
FIG. 1 shows a perspective view of a base of a device according to the invention.
Figure 2:
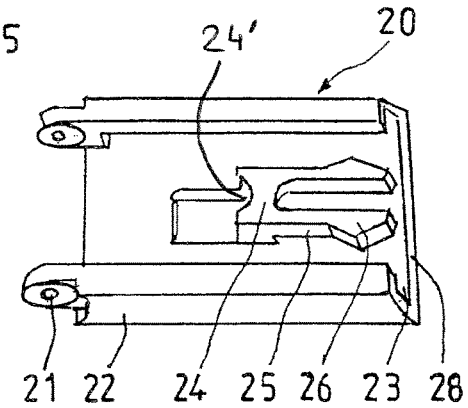
FIG. 2 shows a perspective view of the guiding part the base of the device according to the invention includes.
Figure 3:
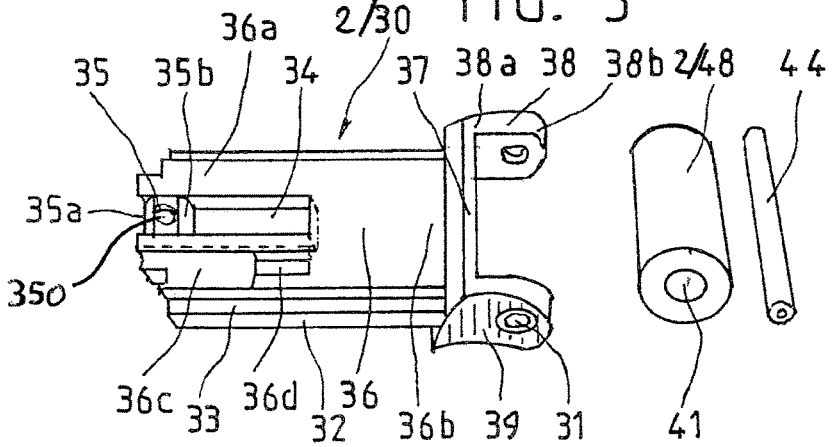
FIG. 3 shows a perspective view of a rolling fork (in particular a telescopic fork) of a device according to the invention.
Figure 5:
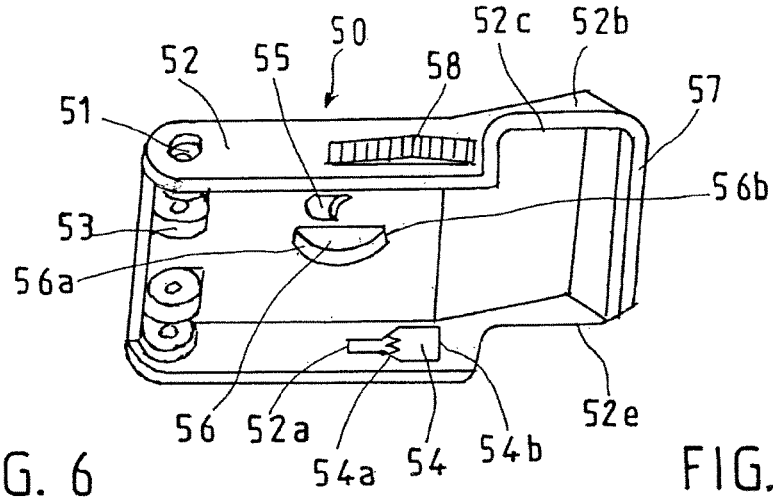
FIG. 5 is a perspective view of a protective cover of a device according to the invention.
Figure 6:
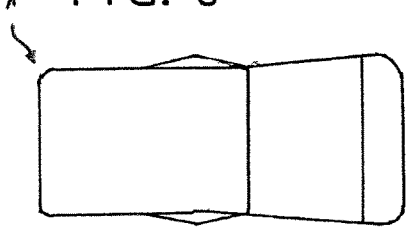
FIG. 6 shows a top plan view of a device according to the invention seen from above in out-of-use position.

Thus and as visible in FIGS. 1 to 13 of the attached drawing, the present invention relates to a device for towing 1 skis, in particular a telescopic device, which comprises:

a base 10 shown in FIG. 1, which is the lower portion of the device.

in a particular embodiment of the invention, a protective cover 50 shown in FIG. 5, which is the upper portion of the device.

a telescopic skid 2 in relation with the base 10, the skid 2 including a telescopic fork 30 and a rolling element 48.

and namely, a guiding part 20 the base 10 includes and which is in relation with said fork 30.

The cohesion of the entire device 1 is ensured by the connection of the parts 10, 20, 50 by an axis 4, which extends through holes 11, 21, 51.

The base 10 is for example a rectangular U-shaped part. The bottom of the base 10, referred to as apron 13, may include perforations 16, located along the side stands 12*a* and 12*b* along a line 15. The base 10 is made integral with the upper portion of the end of the board for board sports 100, which portion is referred to as heel, by screws, glue or any other suitable means. It is made out of any suitable material, for example thermoplastic.

The base 10 is integral with the board for board sports 100. This part connects the other elements of the device 1.

In its front portion, two holes 11 on the side stands 12*a* permit the base 10 to be made integral through the axis 4 and through the holes 51 and 21, on the one hand and outside the base 10, with the protective cover 50 and, on the other hand and inside the base 10, with the telescopic rolling assembly comprised of the guiding part 20, the telescopic fork 30 and the rolling element 48.

The front end of the apron 13*d* forms an arc of a circle serving as an accommodation for a spring 5 and the axis 5 passing through the spring 5. The end 6 of the spring 5 fits into a notch 14 of the apron 13.

The base 10 is divided into two portions. The front portion 10*a*, comprised of a front apron 13*a* and front stands 12*a*, and the rear portion 10*b* comprised of a rear apron 13*b* and rear stands 12*b*.

The notch 17 in the apron 13 marks the separation of the two front 10*a* and rear 10*b* portions and permits the bending of the base 10, thus permitting same to match different curves of the heels of the board for board sports along their longitudinal axis.

The apron 13 of the base 10 has, in its underside 13' starting from the lines 15, thinned edges 13*c* in the form of chamfers.

The stands 12*a* include, at their ends, one or several notches 18 in correlation with teeth 54*a* of bolts 54 of the protective cover 50.

Figure 8:
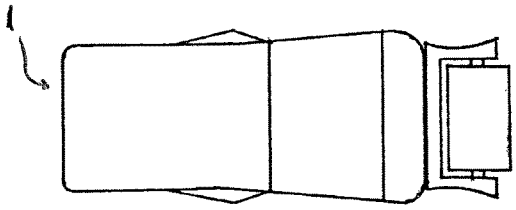
FIG. 8 shows the device of FIG. 6 in a top plan view, in the in-use position.
Figure 7:
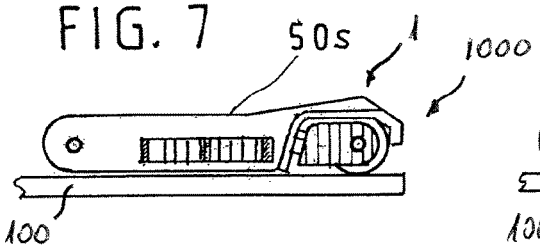
FIG. 7 shows the device of FIG. 6 in a side elevation view, in the out-of-use position.
Figure 9:
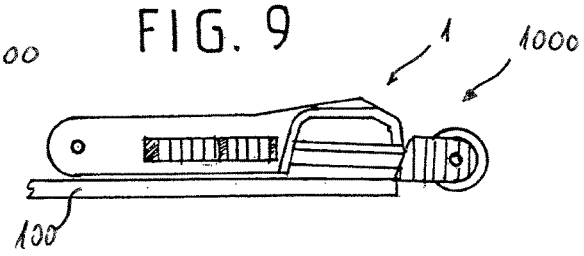
FIG. 9 shows the device of FIG. 6, in a side elevation view, in the in-use position.
Figure 10:
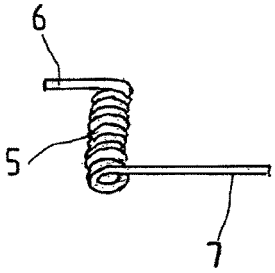
FIG. 10 shows a perspective view of a spring of the device of FIG. 6.
Figure 11:
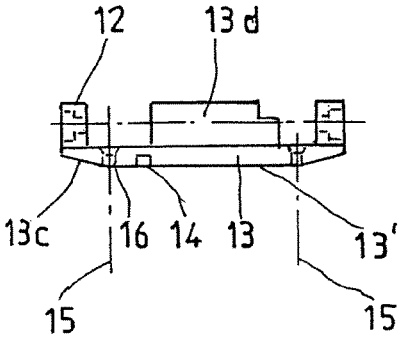
FIG. 11 shows a cross-sectional view of the base of FIG. 1.

The base 10 is positioned on the upper portion of the board for board sports so that the rolling element 48 is located, in the out-of-use position, at the end of the heel of the board for board sports inside the cover 50 (see FIGS. 6 and 7) and, in the in-use position, beyond the heel of the board for board sports outside the cover 50 (see FIGS. 8 and 9).

The guiding part 20 is rectangular and U-shaped. It is aimed at supporting the telescopic fork or guided part 30, which fits in its stands 22. The guiding part 20 is embedded in the base 10 and connected thereto by the axis 4 through the holes 21 of the stands 22. This mounting permits for the guiding part 20 the motions of rotation about the axis 4, permitting the telescopic fork 30 and to the roller element 48 to adopt the necessary inclinations in the in-use and out-of-use positions, irrespective of the longitudinal curve of the heel of the board for board sports.

The side stands 22 of the guiding part 20 include grooves 23 capable of receiving ribs 33 of the telescopic fork 30.

A rib 24 located in the longitudinal axis of the part 20 is comprised of two flexible and retractable tongues 25 separated from the apron 28.

The ends of the tongues 25 are provided with lugs 26.

These lugs 26 are aimed at positioning, at the end of travel, the telescopic fork 30 in the guide part 20.

The lugs 26 may be of various shapes, for example triangular.

The telescopic fork 30 is the support for the roller element 48.

It has a parallelepiped shape in its front portion 36, it is U-shaped in its rear portion 37. The side stands 32 of the front portion 36 each include a rib 33 configured to cooperate with the side grooves 23 of the guiding part 20 in order to permit a sliding of the telescopic fork 30 in the guide part 20.

At the end 36*a* of the front portion 36, in the longitudinal axis, a stop 35, the longitudinal profile of which can be of various shapes (arc of a circle, triangle, trapezoid or e.g. the form of a semicircle), and an opening 34 arranged immediately behind, are aimed at receiving and pushing back a rib 56 of the protective cover 50 at each translation motion of the telescopic fork 30.

In the front portion 36 of the fork 30, a recess 36*c*, which can be of various shapes, for example of cylindrical shape, permits to receive a hook 55 of the protective cover 50.

A recess 36*d* permits to receive the end of the leg 7 of the spring 5.

The rear portion 37 of the telescopic fork 30 includes two legs 38 each having a hole 31. The ends 38*b* of the legs 38 have thicknesses clearly larger than the roots 38*a*, the legs 38 widening at their outer faces 39. The outer faces 39 can be of concave or any other shapes, partially or completely striated.

The legs 38 of the rear portion 37 of the telescopic fork 30 receive the rolling element 48 through an axis 44 arranged through the holes 31.

Figure 4:
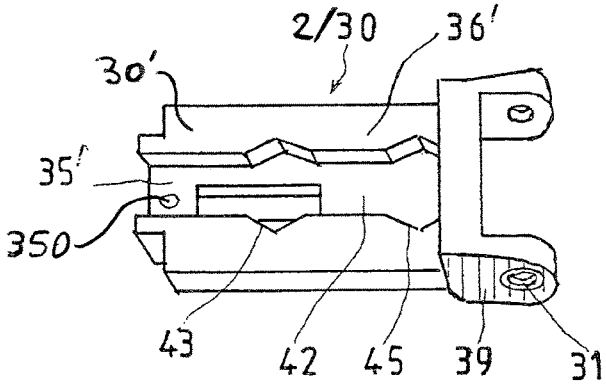
FIG. 4 is a perspective view from below of the rolling fork of FIG. 3.

FIG. 4 shows the underside 30' of the telescopic fork 30.

A recess 42 in its center in the longitudinal axis permits the fitting of the rib 24 of the guide part 20.

In the recess 42 are present notches 43 and 45 designed to receive the lugs 26 of the tongues 25 of the guiding part 20.

The location of the notches 43 and 45 corresponds to the end of travel of the telescopic fork 30.

The notch 43 receives the lugs 26 in the in-use position, the telescopic fork 30 being completely unfolded.

The notch 45 receives the lugs 26 in the out-of-use position, the telescopic fork 30 being completely folded.

The fitting of the lugs 26 in the notches 43 and 45 is aimed at retaining and/or maintaining the telescopic fork 30 in the in-use and out-of-use positions.

The rolling element 48 may be made of an elastic material. It has a cylindrical shape. It may be a cylinder drilled with a hole in its center, it may also be the juxtaposition of several wheels having the same or different thicknesses. The axis 44 passes through the holes 31 of the legs 38 of the rear portion 37 of the telescopic fork 30 and permits the rotating motion of the roller element 48.

The shaft 44 can be blocked in the holes 31 of the legs 38 of the rear portion 37 by a riveting or the clamping of screws or nuts at the ends of the axis 44 previously tapped or threaded.

The protective cover 50 (FIG. 5), having a parallelepiped or trapezoidal shape, covers the base 10 and the telescopic rolling assembly 20, 30, 48.

The ends 52*b* of the side stands 52 have indentations 52*e* the outer faces of which include chamfers 52*c*, which facilitates the gripping of the rolling element 48.

The upper portion 50*s* of the cover 50 may be carved with geometric or heterogeneous shapes or have a more or less flat surface including asperities of various shapes or ridges with omnidirectional orientations.

The cover 50 is connected to the base 10 by the axis 4, which passes through the holes 51 of its side stands 52 and the rings 53.

This mounting permits the protective cover 50 to perform the rotating motions necessary for releasing or enclosing the rolling element 48.

The end 7 of the spring 5 fits into the hook 55, which may be of various shapes or tubular, for example.

The spring 5 is aimed at folding back the protective cover 50 onto the telescopic rolling assembly. Through the tension it exerts onto the protective cover 50 it maintains the telescopic rolling assembly 20, 30, 48 against the heel of the board for board sports, irrespective of its position in space.

An aperture 52*a* on each stand 52 permits tappets 58 located outside the protective cover 50 to drive bolts 54 located inside in a longitudinal displacement permitting the teeth 54*a* of the bolts 54 to fit in the notches 18 of the stands 12*a* of the base 10, thus ensuring the locking of the protective cover 50 on the base 10.

Inside the protective cover 50 the rib 56 positioned in the longitudinal direction is accommodated in the opening 34 of the telescopic fork 30 when the latter is folded into out-of-use position.

Bringing the device into the in-use position 1 occurs with a single hand gesture, by maneuvering in the direction of the rear of the board for board sports the bolts 54 of the protective cover 50 and telescopic fork 30 by pressing on the tappets 58, then on the outer faces 39 of the legs 38 using for example the thumb and the index finger.

The tappets 58 retracted to the rear of the board for board sports permit the teeth 54*a* of the bolt 54 to be released from the notches 18, unlocking the protective cover 50 from the base 10.

During the translational motion of the telescopic fork 30, during its unfolding, the stop 35 exerts by its side 35*a* a pressure on the side 56*a* of the rib 56 of the protective cover 50, in order to lift the latter. The end wall 57 of the protective cover 50 is then lifted, releasing the passage for the rolling element 48.

When the telescopic fork 30 is fully unfolded, the spring 5 exerts a tension on the protective cover 50, through the hook 55, on the portions 35*a* and 36*b* of the telescopic fork 30 by the portions 56*b* and 57 of the protective cover 50 and contributes to maintaining the telescopic fork 30 in its in-use position.

The bringing into the out-of-use position occurs through the rolling element 48 resting on the ground, the board for board sports being in a vertical position.

The rolling element 48 is pushed back into its case, the telescopic fork 30 raising vertically in the guiding part 20.

The side 35*a* of the stop 35 lifts the rib 56 of the protective cover 50 by the portion 56*b*, lifting the end wall 57 of the protective cover 50 during the passing through of the rolling element 48.

When the stop 35 has passed the median axis of the rib 56, under the action of the spring 5 the side 56*a* of the rib 56 exerts a pressure on the side 35*b* of the stop 35 and pushes the telescopic fork 30 into end of travel, completely closing the protective cover 50 and thereby contributing to maintaining the telescopic fork 30 in the out-of-use position.

According to the invention, the device 1 for towing a board for board sports includes a base 10, as described above, and aimed at being mounted on the board for board sports.

This device 1 also includes a skid 2 as described above and likely to adopt, on the one hand, an in-use position, in which this skid 2 is positioned spaced apart with respect to said base 10 (FIG. 11) and, on the other hand, an out-of-use position (FIG. 10), in which said skid 2 is positioned close to said base 10.

This device 1 further includes means for slidably mounting 8 the skid 2 (more particularly the fork 30) relative to said base 10, between the in-use position and the out-of-use position. Such means for slidably mounting 8 will be described in more detail below.

This device 1 also comprises means for retaining the skid 2 in the in-use position comprising, on the one hand, a retaining organ 43 the skid 2 includes and, on the other hand, a complementary retaining organ (25, 26) the means for slidably mounting 8 include. Such a retaining organ 43 and such complementary retaining organ (25, 26) will be described in more detail below.

In fact and according to the invention, said retaining means are designed to adopt, on the one hand, an active position for retaining the skid 2 in the in-use position, for a displacement stress exerted on the skid 2 in the direction of its out-of-use position that is less than a determined stress and, on the other hand, an out-of-use position for retaining, for a stress that is greater than this determined stress.

The device 1 also comprises means for holding said skid 2 in the out-of-use position, said holding means including, on the one hand, a holding organ 45 said skid 2 includes and, on the other hand, a complementary holding organ (25, 26) said means for slidably mounting 8 include, said holding means being designed to adopt, on the one hand, an active position for holding the skid 2 in the out-of-use position, for a displacement stress exerted on said skid 2 in the direction of its in-use position that is less than a determined stress and, on the other hand, an out-of-use position for holding, for a stress that is greater than this determined stress.

According to a first embodiment (not shown), said retaining organ and/or said holding organ are of a retractable type and are designed to be retracted under the action of said displacement stress, on the one hand, exerted onto said skid and in the direction of said position, as the case may be out-of-use or in-use position, and, on the other hand, that is greater than said determined stress. Such a retaining organ and/or such a holding organ can be formed of at least one retractable tongue provided with at least one lug. In such a case, said complementary retaining organ and/or said complementary holding organ are formed of at least one notch designed to cooperate with said lug of said tongue.

However and according to a preferred embodiment shown in FIGS. 2 to 13, said retaining organ 43 and/or said holding element 45 are formed of at least one notch (43, 45), while said complementary retaining organ (25, 26) and/or said complementary holding organ (25, 26) are of a retractable type and are designed to be retracted under the action of said displacement stress, on the one hand, exerted onto said skid 2 and in the direction of said position, as the case may be out-of-use or in-use position, and, on the other hand, that is greater than said determined stress. Here too, such a retaining organ and/or such a holding organ can be formed by at least one retractable tongue 25 provided with at least one lug 26.

Said skid 2 has a free end 37 including sliding means or rolling means 48 as described above as well as below.

Said means for slidably mounting 8 the skid 2 with respect to the base 10 include, on the one hand, a guiding part 20 as well as the means for mounting this guiding part 20 on said base 10 and, on the other hand, a system for slidably mounting the skid 2 on said guiding part 20.

The system for slidably mounting includes, on the one hand, at least one groove 23, respectively at least one rib 24, said base 10 or said guiding part 20 mounted on such a base 10 includes and, on the other hand, at least one rib 33, respectively at least one groove (more particularly formed by the recess 42) said skid 2 includes and which cooperates with said groove 23, respectively with said rib 24 of the base 10 or of said guiding part 20.

Said device 1 includes at least one means preventing said skid 2 from separating from said base 10, in the out-of-use position and/or in the in-use position of said skid 2.

Said means for preventing said skid 2 from separating from said base 10 includes, on the one hand, a stop the skid 2 is provided with and, on the other hand, a bearing surface 24', which said stop 35 cooperates with and the means for slidably mounting (in particular the rib 24 of the system for slidably mounting of the means for slidably mounting 8 include, even the guiding part 20 includes).

As regards said stop of the means preventing the separation, it may be formed by the above-mentioned stop 35 and/or by an organ the skid 2 (more particularly the stop 35 of this skid 2) includes and which adopts more particularly the shape of a rivet, partly inserted into a hole 350 said stop 35 includes and partly protruding out of this hole 350 for cooperating with said bearing surface 24'.

When bringing the device in the in-use position, said organ abuts against the bearing surface 24' and prevents the skid 2 (in particular the fork 30) from sliding further relative to the guiding part 20 in the direction of the in-use position.

Figure 12:
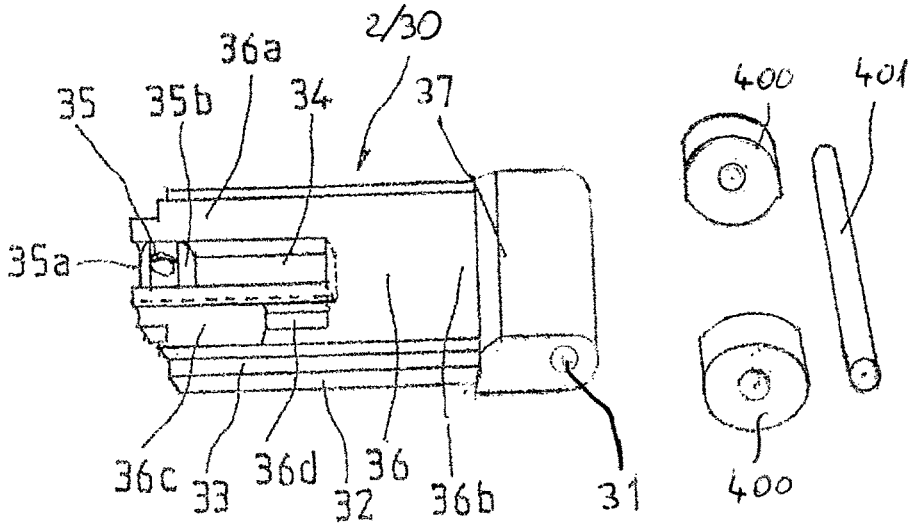
FIG. 12 shows a perspective view of a rolling fork (in particular a telescopic fork) of a device according to another embodiment of the invention.
Figure 13:
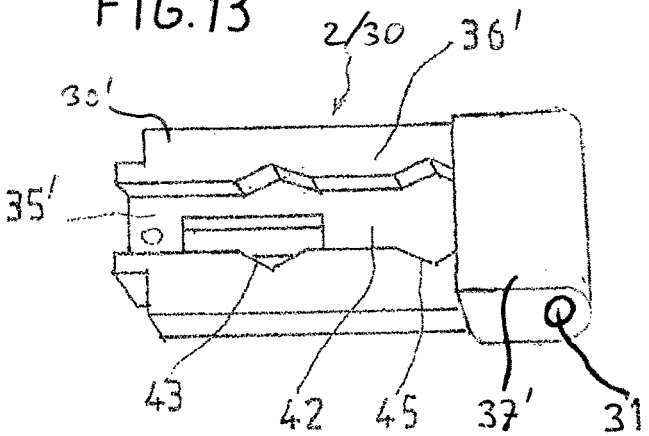
FIG. 13 is a bottom plan view from below of the rolling fork of FIG. 12.

As shown in FIGS. 12 and 13, a second embodiment of the first type of embodiment of the device for towing according to the invention provides the use of a telescopic fork 30 having a rolling system 40 different from the first embodiment described above. This rolling system 40 includes two wheels 400 as well as an axis 401 having two ends each receiving such a wheel 400 of this rolling system 40. This axis 401 is inserted through a through-hole 31, namely a cylindrical hole the rear portion 37 of the fork 30 includes, in particular a block provided on this rear portion 37 of this fork 30 includes.

FIG. 13 shows the underside 30' and the rear portion 37 of the telescopic fork 30.

In FIGS. 14 to 17 is shown a second type of embodiment of the device for towing 1 according to the invention. According to this second type of embodiment, the device for towing 1 includes a skid 2 having a sliding function.

Figure 14:
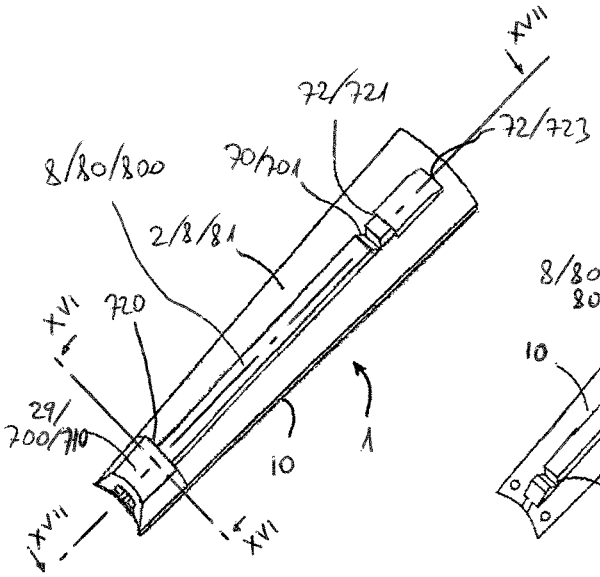
FIG. 14 shows a perspective view of the device according to yet another embodiment of the invention, in the retracted or out-of-use position.
Figure 15:
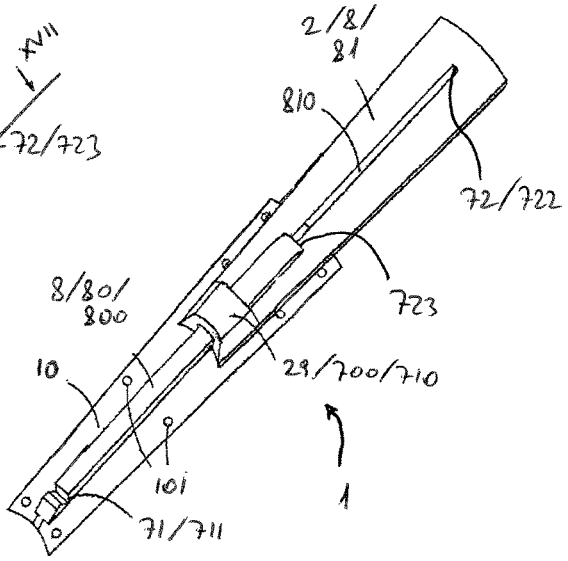
FIG. 15 shows a perspective view similar to FIG. 14 of the device in the unfolded or in-use position.
Figure 16:
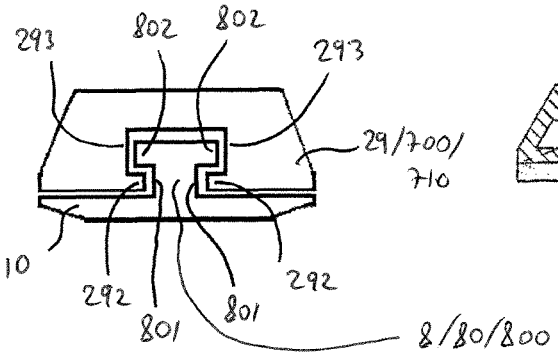
FIG. 16 shows a cross-sectional view along XVI-XVI of the device of FIG. 14.
Figure 17:
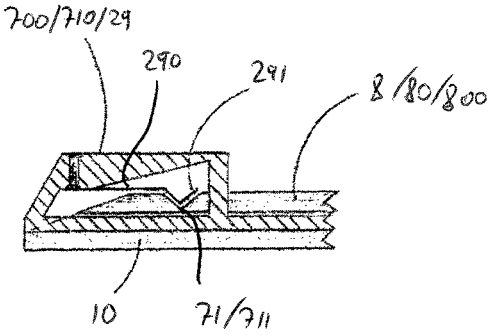
FIG. 17 shows a partial view in longitudinal cross-section along XVII-XVII of the device of FIG. 14.

As can be seen in FIGS. 14 and 15, the device 1 includes, on the one hand, a base 10, which is aimed at being fastened to the board for board sports 100, and which may to this end include at least one through-hole 101 aimed at receiving a fastening organ (in the form of a screw or the like) for fastening this base 10 to the board for board sports 100. On the other hand, this device 1 includes a skid 2, more particularly formed by a spatula or the like. Yet on the other hand, this device 1 includes means for slidably mounting 8 said skid 2 with respect to said base 10.

Such means for slidably mounting 8 include, on the one hand, a guiding part 80 said base 10 includes and which can be formed by a rib, by a rail 800 or the like provided for on said base 10 or fastened to this base 10 and, on the other hand, by a guided part 81 the skid 2 includes and which includes a groove, an aperture 810 or the like cooperating with the rib, the rail or the like of the guiding part 80.

According to another feature, the device 1 includes means for retaining 70 the skid 2 in the in-use position, these retaining means 70 including, on the one hand, a retaining organ 700 the skid 2 includes and, on the other hand, a complementary retaining organ 701 the means for slidably mounting 8 include (in particular, the guiding part 80 includes).

Here too, said retaining means 70 are designed to adopt, on the one hand, an active position for retaining the skid 2 in the in-use position, for a displacement stress exerted on the skid 2 and in the direction of its out-of-use position that is less than a determined stress and, on the other hand, an out-of-use position for retaining, for a stress that is greater than this determined stress.

Yet another feature consists in that the device 1 includes means for holding 71 said skid 2 in the out-of-use position, said holding means 71 including, on the one hand, a holding organ 710 said skid 2 includes and, on the other hand, a complementary holding member 711 said means for slidably mounting 8 include. These holding means 71 are designed to adopt, on the one hand, an active position for retaining the skid 2 and in the direction of its out-of-use position, at a stress of displacement exerted on said skid 2 and in the direction of its in-use position that is less than a determined stress and, on the other hand, an out-of-use position for retaining, for a stress that is greater than this determined stress.

According to a first embodiment (not shown), said retaining organ and/or said holding organ are formed by at least one notch, while said complementary retaining organ and/or said complementary holding organ are of a retractable type and are designed to be retracted under the action of said displacement stress, on the one hand, exerted on said skid in the direction of said position, as the case may be out-of-use or in-use position, and, on the other hand, that is greater than said determined stress. Here too, such a retaining organ and/or such a holding organ can be formed by at least one retractable tongue provided with at least one lug.

However and according to a preferred embodiment shown in FIGS. 14 to 17, said retaining organ 700 and/or said holding organ 710 are of a retractable type and are designed to be retracted under the action of said displacement stress, on the one hand, exerted on said skid 2 and in the direction of said position, as the case may be out-of-use or in-use position, and, on the other hand, that is greater than said determined stress. Such a retaining organ 700 and/or such a holding organ 710 may be formed by at least one retractable tongue 290 provided with at least one lug 291. In such a case, said complementary retaining organ 701 and/or said complementary holding organ 711 are formed by at least one notch 711 designed to cooperate with said lug 291 of said tongue 290.

In this respect, it should be noted that such a retaining organ 700 and/or such a holding organ 710 (more particularly in the form of an above-mentioned retractable tongue 290) can be provided on the guided part 81 of the means for slidably mounting 8 and/or a pushing block 29 associated with the skid 2 (more particularly with the guided part of this skid 2) and designed for manipulating said skid 2 in order to bring it into position, as the case may be out-of-use or in-use position.

As regards said complementary retaining organ 701 and/or said complementary holding organ 711, they (701; 711) can be provided on the guiding part 80 of the means for slidably mounting 8, in particular the above-mentioned rib or rail 800.

In fact, said complementary retaining organ 701 is provided at a proximal end of the guiding part 80 and/or the base 10, namely an end aimed at being positioned proximate the end (rear edge) of the board for board sports 100.

As regards the complementary holding organ 711, it is provided at a distal end of the guiding part 80 and/or the base 10, namely an end aimed at being positioned spaced apart from the end (rear edge) of the board for board sports 100.

According to a particular embodiment, said retaining organ 700 and said holding organ 710 coincide and are formed by one single retractable tongue 290 as mentioned above.

The device 1 includes at least one means 72 preventing the skid 2 from separating from the base 10, in the out-of-use position and/or the in-use position. The skid 2 can thus remain associated with the board for board sports 100 during its use for sliding or during its transport, even its storage. The user thus no longer needs to remove the skid with the risk of losing it.

In fact, this means 72 preventing said skid 2 from separating (in in-use position) from said base 10 includes, on the one hand, a stop 720 provided for on the skid 2, in particular the guided part 81 of the means for slidably mounting 8 this skid 2 includes and, on the other hand, a bearing surface 721, which cooperates with said stop 720 and which the base 10 includes, more particularly the guiding part 80 of the means for slidably mounting 8 this base 10 includes.

In addition, this means 72 preventing said skid 2 from separating (in the out-of-use position) of said base 10 includes, on the one hand, a stop 722 provided for on the skid 2, in particular the guided part 81 of the means for slidably mounting 8 this skid 2 includes and, on the other hand, a bearing surface 723, which cooperates with said stop 720 and which the base 10 includes, more particularly the guiding part 80 of the means for slidably mounting 8 this base 10 includes.

The device 1 also includes at least one means for making integral in displacement for making integral the skid 2 and the base 10, more particularly between the in-use and out-of-use positions of the skid 2 and in translation in the in-use-out-of-use directions, and vice versa. These means for making integral advantageously permit to maintain the skid 2 and the base 10 integral, despite the displacement of said skid 2 with respect to said base 10, more particularly in a direction perpendicular to the direction of displacement of said skid 2.

Such a means for making integral includes, on the one hand, ribs 292, respectively grooves 293, the skid 2 (more particularly the pushing block 29 and/or the guided part 81 of this skid 2) includes and, on the other hand, grooves 801, respectively ribs 802 the base 10 (more particularly the rail 800 of the guiding part 80) includes and which cooperate with said ribs of the skid 2.

Finally, the invention also relates to an assembly 1000 formed by a board for board sports 100 as mentioned above and by the device for towing 1 (having the features described above).

The advantage of the present invention resides in particular in that it advantageously simplifies the use of the device for towing the board for board sports in all situations, of sliding, towing and storage by permitting to keep the means for towing integral with the board for board sports.

Another obvious advantage of the invention is the capacity of the user to perform the putting into operation, respectively the putting out of operation, of the device by a simple hand motion, by exerting a force that is greater than the stress force of the means for retaining in the in-use position, respectively of the means for maintaining in the out-of-use position.

I claim:

1. A device for towing a board, said device comprising:

a base;

a skid being in sliding engagement with said base and being comprised of a guiding part and a guided part, said guiding part being connected to said base and between said base and said guided part, wherein said skid has a first position and a second position, wherein said first position corresponds to an in-use position, wherein said guided part of said skid is positioned spaced apart from said base in said first position, wherein said second position corresponds to an out-of-use position, and wherein said guided part of said skid is positioned closer to said base in said second position than in said first position; and means for sliding said skid between said first position and said second position; and means for retaining said skid in said first position, wherein said means for retaining said skid in said first position has an active retaining position corresponding to snap fit engagement, wherein said snap fit engagement in said active retaining position has a determined retaining stress greater than a displacement retaining stress in a direction from said first position to said second position, wherein said means for retaining said skid in said first position has a released retaining position or out-of-use position corresponding to release of said snap fit engagement in said active retaining position, and wherein said determined retaining stress is less than said displacement retaining stress in said released retaining position.

2. The device for towing, according to claim 1, further comprising:

means for holding said skid said second position, wherein said means for holding said skid in said second position has an active holding position corresponding to snap fit engagement, wherein said snap fit engagement in said active holding position has a determined holding stress greater that a displacement holding stress in a direction from said second position to said first position, wherein said means for retaining said skid in said second position has a released holding position corresponding to release of said snap fit engagement in said active holding position, and wherein said determined holding stress is less than said displacement holding stress in said released holding position.

3. The device for towing, according to claim 2, wherein said active holding position of said means for holding said skid in said second position corresponds to retracted engagement.

4. The device for towing, according to claim 3, wherein said snap fit engagement is comprised of a notch and lug engagement.

5. The device for towing, according to claim 2, wherein said active holding position of said means for holding said skid in said second position corresponds to retracted engagement.

6. The device for towing, according to claim 5, wherein said retracted engagement is comprised of a notch and lug engagement.

7. The device for towing, according to claim 1, further comprising:

a rolling means, said guided part of said skid being between said base and said rolling means, wherein said skid has a free end, said rolling means being mounted at said free end.

8. The device for towing, according to claim 1, wherein said means for sliding said skid between said first position and said second position comprises:

means for mounting said guiding part on said base; and means for sliding said guided part on said guiding part.

9. The device for towing, according to claim 8, wherein said means for sliding said guided part on said guiding part corresponds to groove-rib engagement between said guiding part and said guided part.

10. The device for towing, according to claim 1, further comprising:

means for preventing said guided part of said skid from separating from said base.

11. The device for towing, according to claim 10, wherein said means for sliding said skid between said first position and said second position is comprised of said means preventing said guided part of said skid from separating from said base.

12. An assembly, comprising:

a board for board sports; and a device, according to claim 1, said device being attached to said board.

* * * * *